US009657458B2

(12) United States Patent
Hutchinson et al.

(10) Patent No.: US 9,657,458 B2
(45) Date of Patent: May 23, 2017

(54) AUXILIARY POWER UNIT EXCAVATOR SYSTEM

(71) Applicant: Company Wrench, Ltd., Carroll, OH (US)

(72) Inventors: Brad Hutchinson, Rushville, OH (US); Eric Thornton, Lancaster, OH (US)

(73) Assignee: Company Wrench, Ltd., Carroll, OH (US)

( * ) Notice: Subject to any disclaimer, the term of this patent is extended or adjusted under 35 U.S.C. 154(b) by 284 days.

(21) Appl. No.: 14/616,926

(22) Filed: Feb. 9, 2015

(65) Prior Publication Data

US 2015/0225926 A1 Aug. 13, 2015

Related U.S. Application Data

(60) Provisional application No. 61/939,006, filed on Feb. 12, 2014.

(51) Int. Cl.

| | |
|---|---|
| ***E02F 9/08*** | (2006.01) |
| ***E02F 9/22*** | (2006.01) |
| ***E02F 9/16*** | (2006.01) |
| ***F02B 73/00*** | (2006.01) |
| ***E02F 9/20*** | (2006.01) |

(52) U.S. Cl.

CPC ..... *E02F 9/0866* (2013.01); *E02F 9/0808* (2013.01); *E02F 9/0833* (2013.01); *E02F 9/0883* (2013.01); *E02F 9/163* (2013.01); *E02F 9/2075* (2013.01); *F02B 73/00* (2013.01)

(58) Field of Classification Search

CPC ... E02F 9/0866; E02F 9/16; E02F 9/22; E02F 9/0833; E02F 9/0808; E02F 9/0883; E02F 9/163; E02F 9/2075; F02B 73/00

See application file for complete search history.

(56) References Cited

U.S. PATENT DOCUMENTS

2013/0186590 A1* 7/2013 Johnson ..... B60H 1/323 165/11.1

2015/0039187 A1* 2/2015 Friebel ..... E02F 9/2246 701/50

* cited by examiner

*Primary Examiner* — Jacob Amick

(74) *Attorney, Agent, or Firm* — Ice Miller LLP

(57) ABSTRACT

An auxiliary power unit excavator system comprises a vehicular base powered by a first internal combustion engine enabling excavator mobility, an excavator boom assembly disposed on a top side of the vehicular base, an auxiliary power unit assembly disposed on a top side of the vehicular base, a cab disposed above the vehicle base, and a second internal combustion engine powering a generator.

20 Claims, 18 Drawing Sheets

AUXILIARY POWER UNIT EXCAVATOR SYSTEM

RELATED APPLICATION DATA

This application claims the priority benefit of U.S. Provisional Application Ser. No. 61/939,006, filed Feb. 12, 2014, which is hereby incorporated in its entirety herein by reference.

FIELD OF THE DISCLOSURE

This disclosure is directed generally to auxiliary power systems and, in particular, auxiliary power systems for heavy equipment vehicles.

BACKGROUND

Several problems are associated with extended idling periods of EPA Tier IV diesel engines in construction equipment or heavy equipment. Exhaust after treatment systems, such as those used to meet EPA Tier IV emission requirements, are designed to function at normal engine operating speed and typical load with relatively short periods of no load idling. At normal engine operating speed and typical load, pollutant emissions in the diesel engine exhaust being introduced to the exhaust after treatment system are significantly lower than at idle and no load. This is primarily due to the lower exhaust gas temperature of the idling, no load engine, which does not burn up as many of the pollutants before introduction of the exhaust gas to the after treatment system. However, on job sites in very cold climates and with no access to electrical power for operating devices like engine coolant heaters or engine oil heaters, the typical method used to guarantee a diesel engine powered piece of construction equipment would be operational at the beginning of the work day is to let the large diesel engine of the heavy equipment idle overnight. This solution to the cold climate starting problem causes the accumulation of excessive operating hours on the construction equipment, the consumption of significant quantities of diesel fuel, and the constant release of excessive amounts of environmentally damaging diesel exhaust gases into the atmosphere. Moreover, operating an engine, such as one regulated as an EPA Tier IV engine, at idle with no load for extended periods, such as overnight periods, causes the exhaust after treatment system to fail over time and the engine to shut down until repairs are made.

Additionally, hydraulic excavator required support functions of an oil or gas well drilling operation present additional problems. As a drill rig creates the well hole, drilling solution is pumped into the hole. A slurry mixture of drilling solution and drilled particulate material is pumped out of the well hole. After removal from the well hole, this slurry mixture is processed to reclaim most of the drilling solution. The remaining material is dumped into a large, high sided, open topped hopper. After a sufficient volume of material is placed into the hopper, a solidifying agent such as clay, sand, or straw is added to the material using a hydraulic excavator. The hydraulic excavator is then used to mix the solidifying agent with the material to create a semi-solid material which can be accepted by a landfill. After mixing is complete, the hydraulic excavator is additionally used to load the material from the hopper into dump trucks. Once the drilling process begins, the drill rig runs 24 hours per day, 7 days per week until the well is finished. Job requirements mandate that the supporting hydraulic excavator be on site warmed up, fully functional, and ready to work with an operator standing by the entire time the drill rig is running. The nature of the drilling process is such that 4 to 6 hours may pass before a sufficient volume of material is placed in the hopper to require mixing and removal by the hydraulic excavator. The mixing and removal process can typically be completed in approximately 2 hours. As such, in a 24 hour period, the hydraulic excavator will only be working 6 to 8 hours. Since the hydraulic excavator and operator are required to be in a state of constant readiness at all times the drill rig is running, the hydraulic excavator is left idling at no load for 16 to 18 hours out of 24 in order to keep the diesel engine and hydraulic system up to operating temperature and to provide climate control and auxiliary power to the operator. This mode of operations accumulates excessive operating hours on the construction equipment and consumes significant quantities of diesel fuel. The mixing and removal process is further complicated by the height of the hopper sides relative to the height of the operator in the cab of the hydraulic excavator. A conventional hydraulic excavator of appropriate size for this task does not elevate the operator high enough to have adequate visibility inside the hopper for the mixing and removal process.

Therefore, problems exist relating to equipment system readiness and avoiding cold starting a piece of heavy equipment, such as the accumulation of excessive operating hours on the construction equipment, the consumption of significant quantities of diesel fuel, the excessive release of exhaust gases, and the failure of exhaust after treatment systems. Additionally, the tasks required by an excavator on a job site present additional problems, such as inadequate visibility for a mixing and removal process. The auxiliary power unit excavator system of the present disclosure provides a solution to all of these problems.

BRIEF SUMMARY

In accordance with an aspect of the disclosure, an auxiliary power unit excavator system is provided comprising a vehicular base comprising a transmission, a circulating hydraulic fluid system, an excavator boom assembly disposed on a top side of the vehicular base and comprising at least one hydraulic actuator coupled to the circulating hydraulic fluid system, a fuel tank, a first internal combustion engine comprising a fuel conduit system, a fuel conduit system connecting the fuel tank to the first internal combustion engine, an auxiliary power unit enclosure disposed on a top side of the vehicular base, and a cab disposed above the auxiliary power unit enclosure. The enclosure contains an auxiliary power unit comprising a second internal combustion engine fluidly coupled to a first coolant volume and powering an alternating current generator and a second coolant volume compressor, a second coolant volume condenser assembly fluidly coupled to the second coolant volume compressor, the second coolant volume condenser assembly comprising a second coolant volume condenser fan, a second internal combustion engine radiator configured to cool the first coolant volume, and an electrical converter electrically coupled to the alternating current generator and configured to supply direct current electricity to a battery and a hydraulic fluid heating assembly.

The cab may further comprise an evaporator fluidly coupled to the second coolant volume. The cab may further comprise a heater core fluidly coupled to the first coolant volume. The auxiliary power unit excavator system may further comprise a first internal combustion engine starter electrically coupled to the battery such that the battery is configured to supply electrical power to the first internal combustion engine starter. The electrical converter electrically coupled to the alternating current generator may be configured to supply direct current electricity to a cab operator outlet. The electrical converter may be electrically coupled to the alternating current generator through an alternating current breaker panel. The second coolant volume condenser assembly may be disposed on an auxiliary power unit enclosure first side adjacent the excavator boom assembly, wherein air is directed into the auxiliary power unit enclosure at the second coolant volume condenser assembly. The auxiliary power unit enclosure may further comprise an air outlet disposed at an auxiliary power unit enclosure second side located at a lower end of the auxiliary power unit enclosure. The air directed into the auxiliary power unit enclosure may be directed out of the auxiliary power unit enclosure through the air outlet. The auxiliary power unit enclosure may further comprise a second internal combustion engine exhaust assembly disposed in an air pathway defined by the air flowing between the second coolant volume condenser assembly and the air outlet. The second internal combustion engine radiator may be disposed on the auxiliary power unit enclosure first side adjacent the excavator boom assembly. The electrical converter may be disposed on an auxiliary power unit enclosure third side located at a rear end of the auxiliary power unit enclosure.

In accordance with further aspects of the present disclosure, an auxiliary power unit excavator system is provided comprising a vehicular base powered by a first internal combustion engine enabling excavator mobility, an excavator boom assembly disposed on a top side of the vehicular base, an auxiliary power unit enclosure disposed on a top side of the vehicular base, and a cab disposed above the auxiliary power unit enclosure. The auxiliary power unit enclosure at least partially encloses a second internal combustion engine fluidly coupled to a first coolant volume and powering an alternating current generator and a second coolant volume compressor, a second coolant volume condenser assembly fluidly coupled to the second coolant volume compressor wherein the second coolant volume condenser assembly comprises a second coolant volume condenser fan, a second internal combustion engine radiator configured to cool a first coolant volume, and an electrical converter electrically coupled to the alternating current generator and configured to supply direct current electricity to a battery and a hydraulic fluid heating assembly.

The cab may further comprise an evaporator fluidly coupled to the second coolant volume. The cab may further comprise a heater core fluidly coupled to the first coolant volume. The auxiliary power unit excavator system may further comprise a first internal combustion engine starter electrically coupled to the battery such that the battery is configured to supply electrical power to the first internal combustion engine starter. The electrical converter electrically coupled to the alternating current generator may be configured to supply direct current electricity to a cab operator outlet. The electrical converter may be electrically coupled to the alternating current generator through an alternating current breaker panel. The second coolant volume condenser assembly may be disposed on an auxiliary power unit enclosure first side adjacent the excavator boom assembly, wherein air is directed into the auxiliary power unit enclosure at the second coolant volume condenser assembly. The auxiliary power unit enclosure may further comprise an air outlet disposed at an auxiliary power unit enclosure second side located at a lower end of the auxiliary power unit enclosure. The air directed into the auxiliary power unit enclosure may be directed out of the auxiliary power unit enclosure through the air outlet. The auxiliary power unit enclosure may further comprise a second internal combustion engine exhaust assembly disposed in an air pathway defined by the air flowing between the second coolant volume condenser assembly and the air outlet. The second internal combustion engine radiator may be disposed on the auxiliary power unit enclosure first side adjacent the excavator boom assembly. The electrical converter may be disposed on an auxiliary power unit enclosure third side located at a rear end of the auxiliary power unit enclosure.

In accordance with further aspects of the present disclosure, an auxiliary power unit excavator system is provided comprising a vehicular base powered by a first internal combustion engine enabling excavator mobility, an excavator boom assembly disposed on a top side of the vehicular base, an auxiliary power unit enclosure disposed on a top side of the vehicular base, and a cab disposed above the vehicular base, wherein the auxiliary power unit enclosure at least partially encloses a second internal combustion engine powering a generator and a compressor fluidly coupled to an air conditioning coolant, a condenser assembly fluidly coupled to the compressor, the condenser assembly comprising a condenser fan configured to direct air into the auxiliary power unit enclosure, an air outlet disposed at an auxiliary power unit enclosure side, wherein the air directed into the auxiliary power unit enclosure is directed out of the auxiliary power unit enclosure through the air outlet, and a second internal combustion engine exhaust assembly disposed in an air pathway defined by the air flowing between the condenser assembly and the air outlet. The cab may further comprise an evaporator fluidly coupled to an engine coolant fluidly coupled to the second internal combustion engine. The cab may further comprise a heater core fluidly coupled to the engine coolant. The auxiliary power unit excavator system may further comprise an electrical converter electrically coupled to the generator and configured to supply direct current electricity to a battery. The auxiliary power unit excavator system may further comprise a first internal combustion engine starter electrically coupled to the generator through the battery such that the battery is configured to supply electrical power to the first internal combustion engine starter. The auxiliary power unit excavator system may further comprise an electrical converter electrically coupled to the generator and configured to supply direct current electricity to a hydraulic fluid heating assembly. The electrical converter may be configured to supply direct current electricity to a cab operator outlet. The electrical converter may be electrically coupled to the generator through an alternating current breaker panel.

In accordance with further aspects of the present disclosure, an auxiliary power unit excavator system is provided comprising a vehicular base powered by a first internal combustion engine enabling excavator mobility, an excavator boom assembly disposed on a top side of the vehicular base, a cab disposed above the vehicle base, a second internal combustion engine powering a generator, a hydraulic fluid heating assembly electrically coupled to at least one of the second internal combustion engine and the generator, and a first internal combustion engine heating means connecting at least one of the second internal combustion engine and the generator with the first internal combustion engine, wherein the first internal combustion engine heating means is configured to heat the first internal combustion engine after shutdown of the first internal combustion engine.

BRIEF DESCRIPTION OF THE FIGURES

While the specification concludes with claims particularly pointing out and distinctly claiming the present disclosure, it is believed that the present disclosure will be better understood from the following description in conjunction with the accompanying Drawing Figures, in which like reference numerals identify like elements, and wherein:

DETAILED DESCRIPTION

In the following detailed description of the disclosed embodiment, reference is made to the accompanying drawings that form a part hereof, and in which is shown by way of illustration, and not by way of limitation, a specific disclosed embodiment in which the disclosure may be practiced. It is to be understood that other embodiments may be utilized and that changes may be made without departing from the spirit and scope of the present disclosure.

Figure 1:
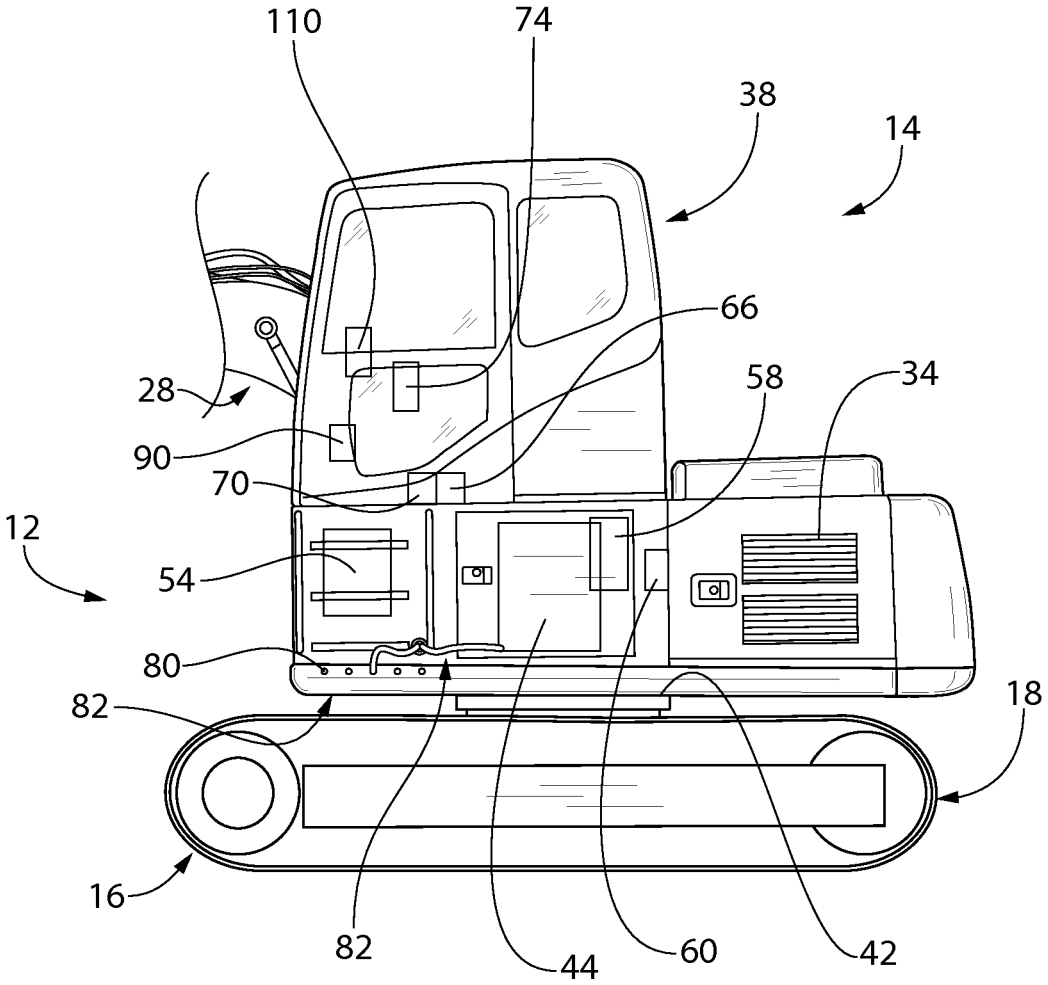
FIG. 1 is a left side plan view of an auxiliary power unit excavator system according to aspects of the present disclosure.
Figure 2:
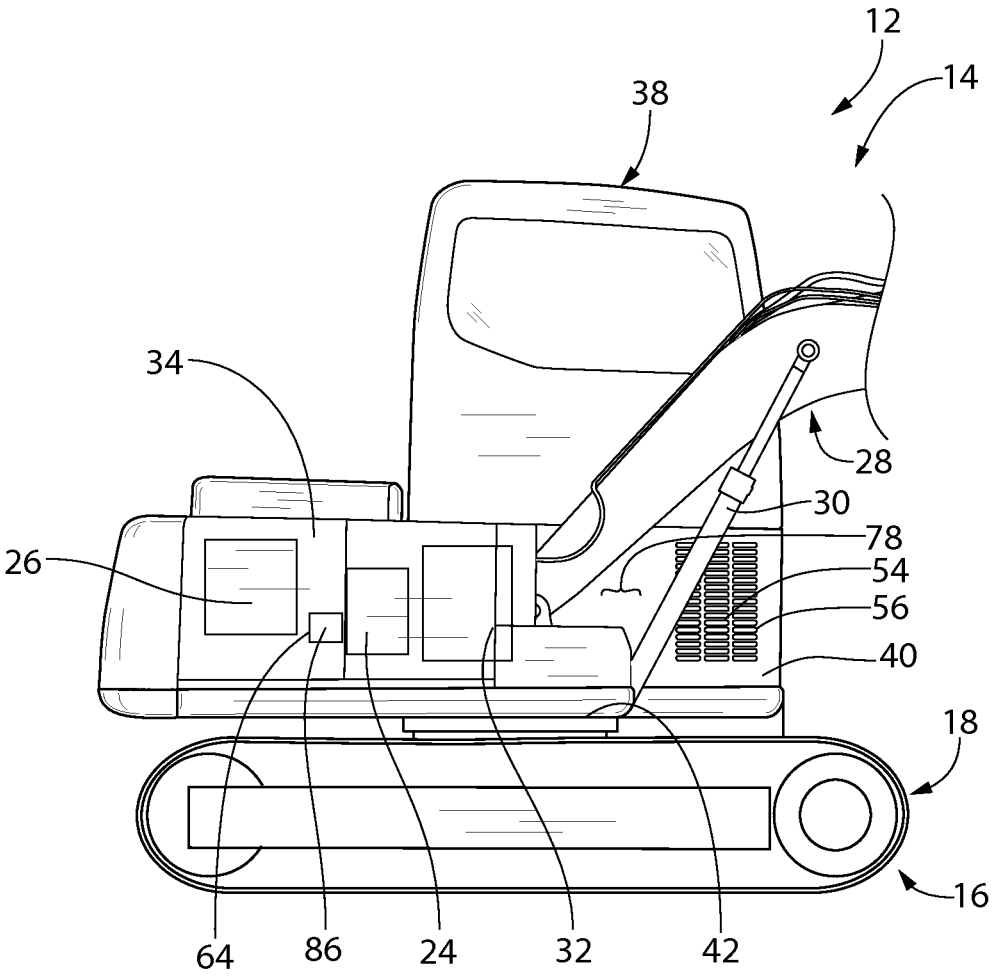
FIG. 2 is a right side plan view of the auxiliary power unit excavator system according to aspects of the present disclosure.
Figure 3:
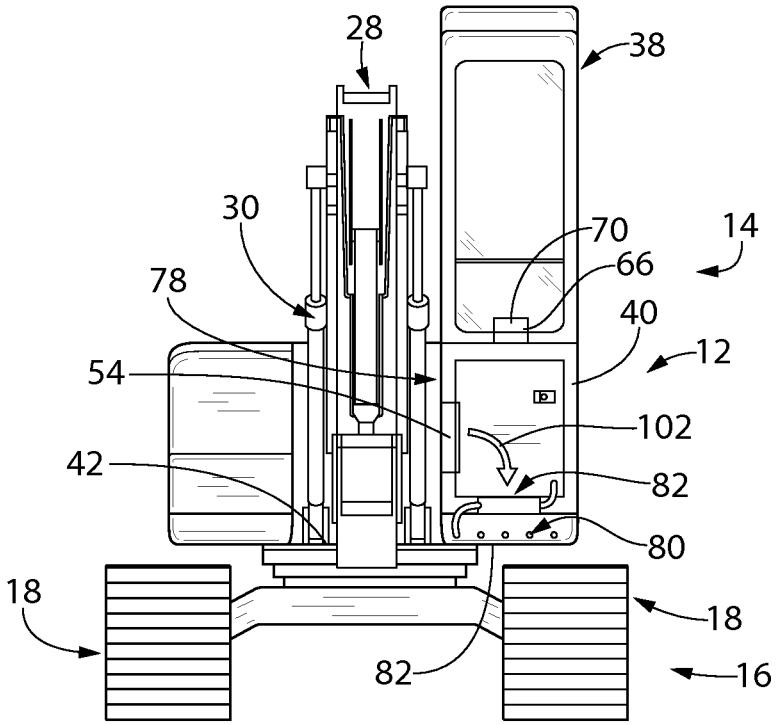
FIG. 3 is a front side plan view of the auxiliary power unit excavator system according to aspects of the present disclosure.
Figure 4:
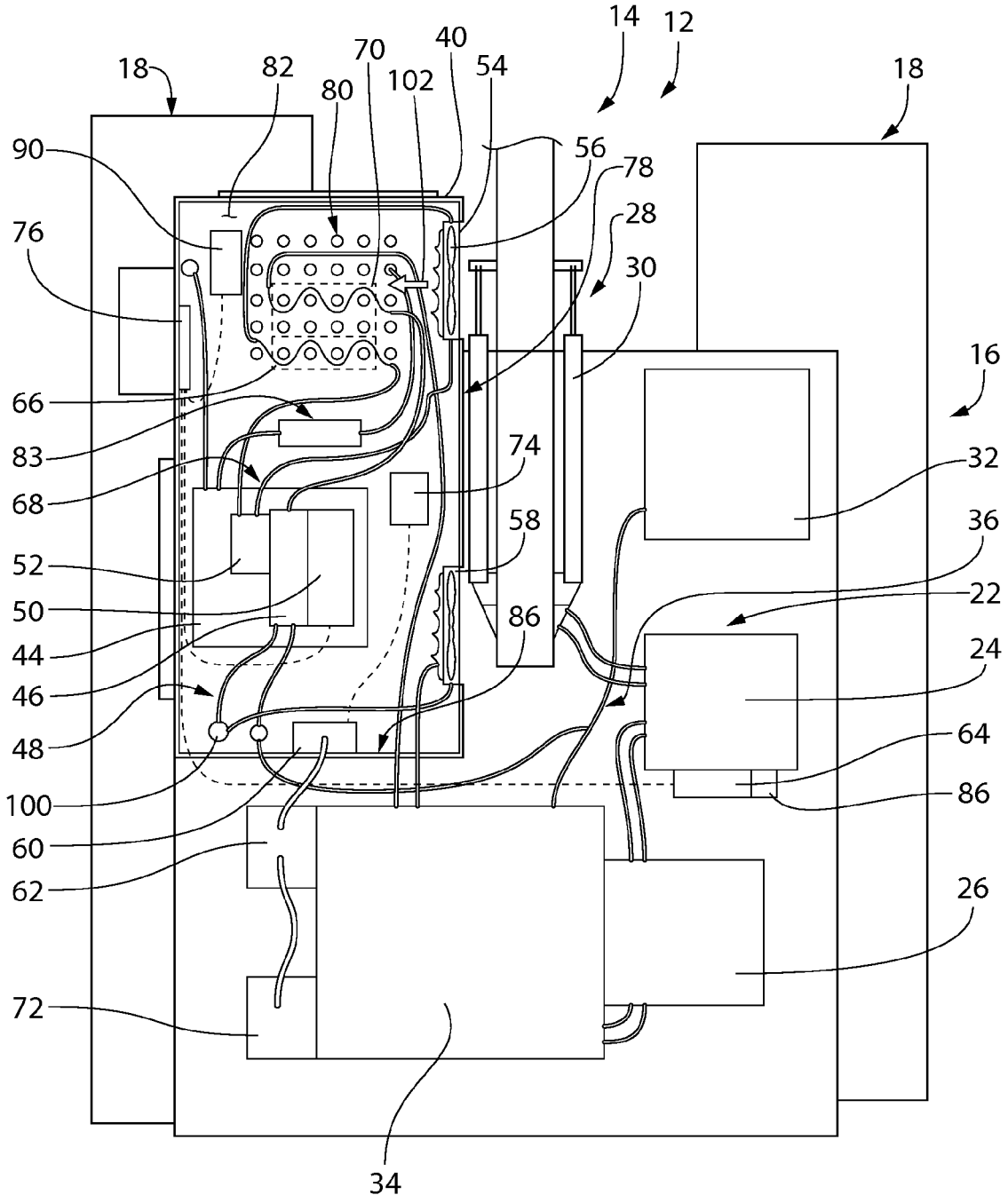
FIG. 4 is a top cross-sectional view of the auxiliary power unit excavator system according to aspects of the present disclosure.
Figure 5:
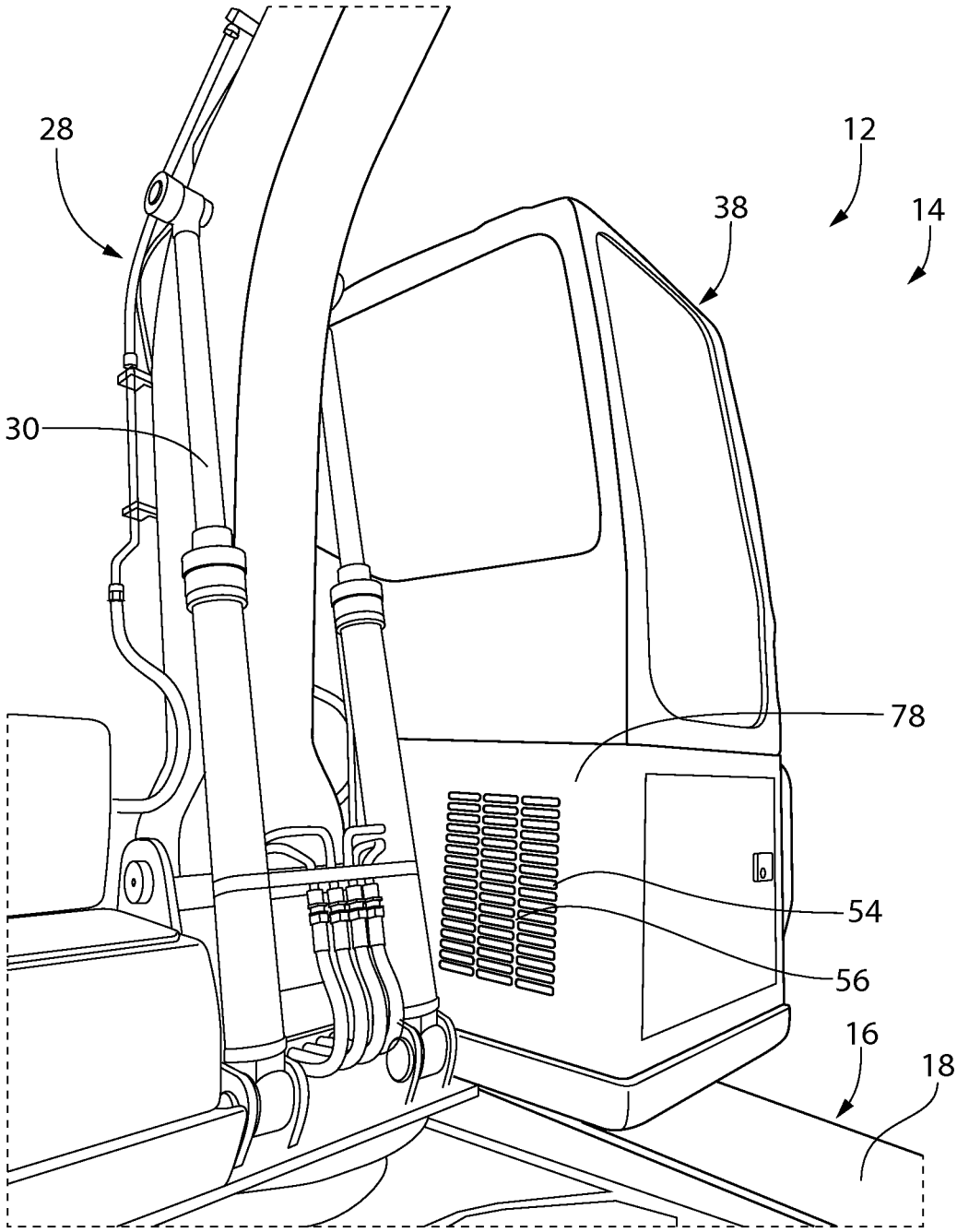
FIG. 5 is a right side perspective view of the auxiliary power unit excavator system according to aspects of the present disclosure.
Figure 6:
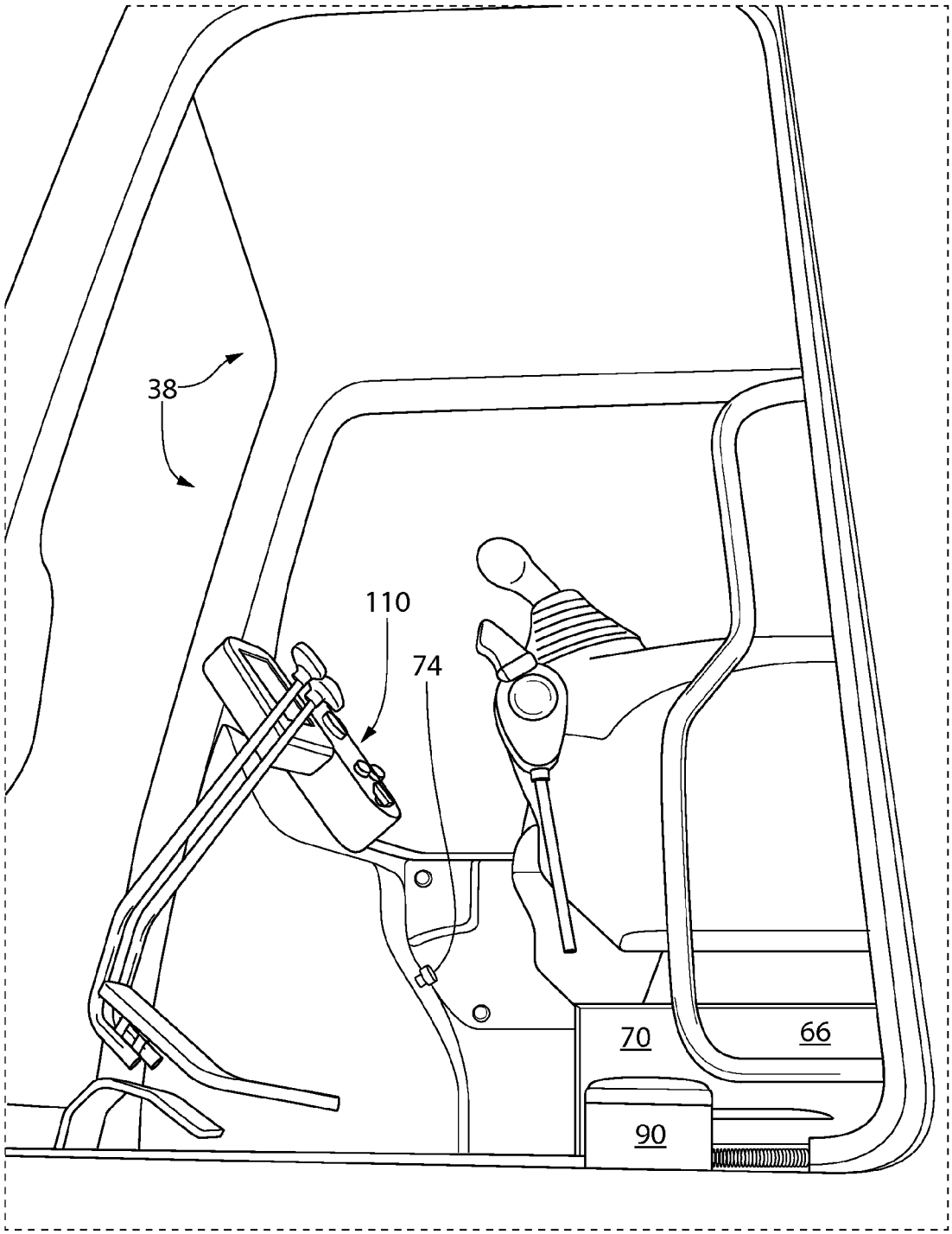
FIG. 6 is a left side perspective view of the auxiliary power unit excavator system according to aspects of the present disclosure.
Figure 7:
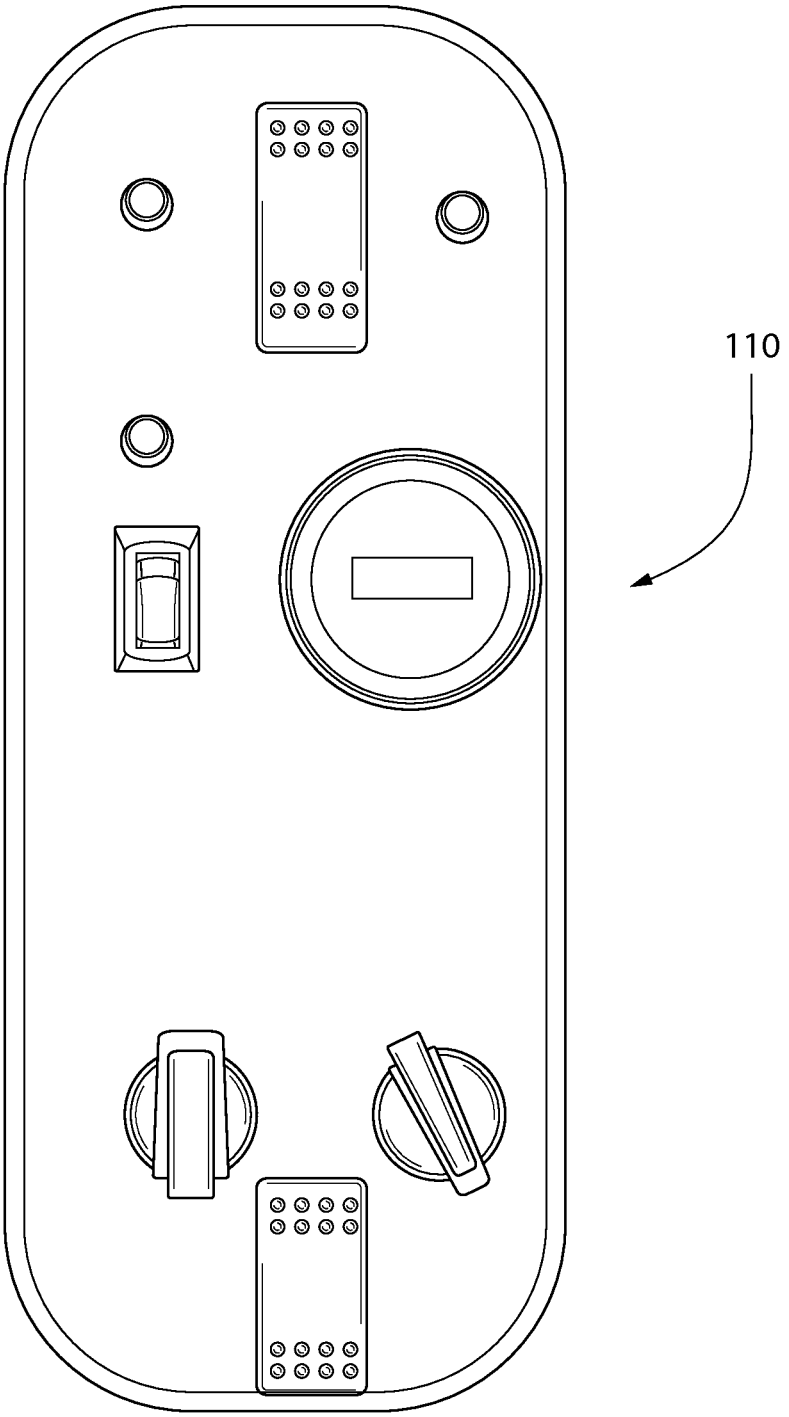
FIG. 7 is a top perspective view of a system controller of the auxiliary power unit excavator system according to aspects of the present disclosure.
Figure 8:
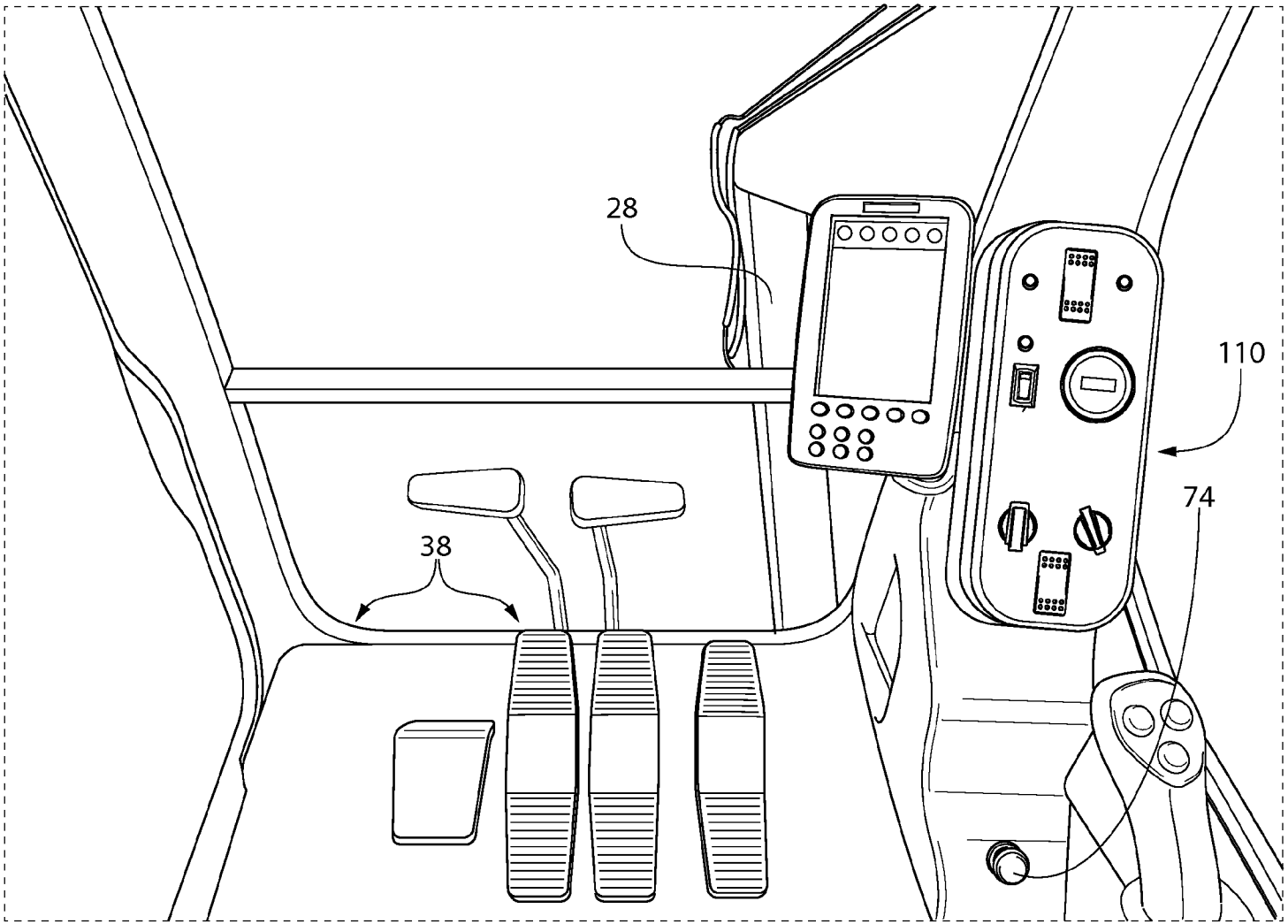
FIG. 8 is an interior perspective view of the auxiliary power unit excavator system according to aspects of the present disclosure.
Figure 9:
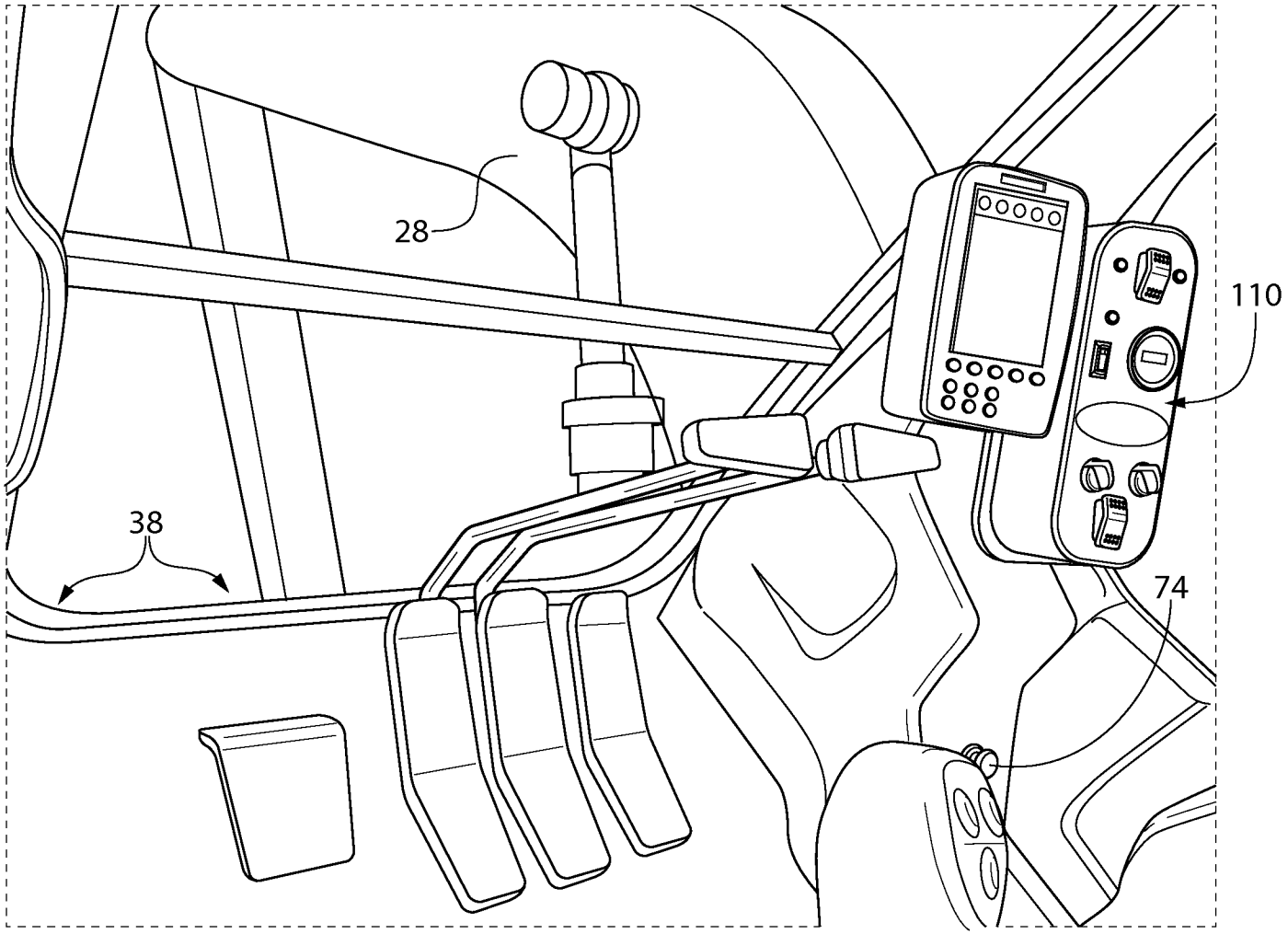
FIG. 9 is an interior perspective view of the auxiliary power unit excavator system according to aspects of the present disclosure.
Figure 10:
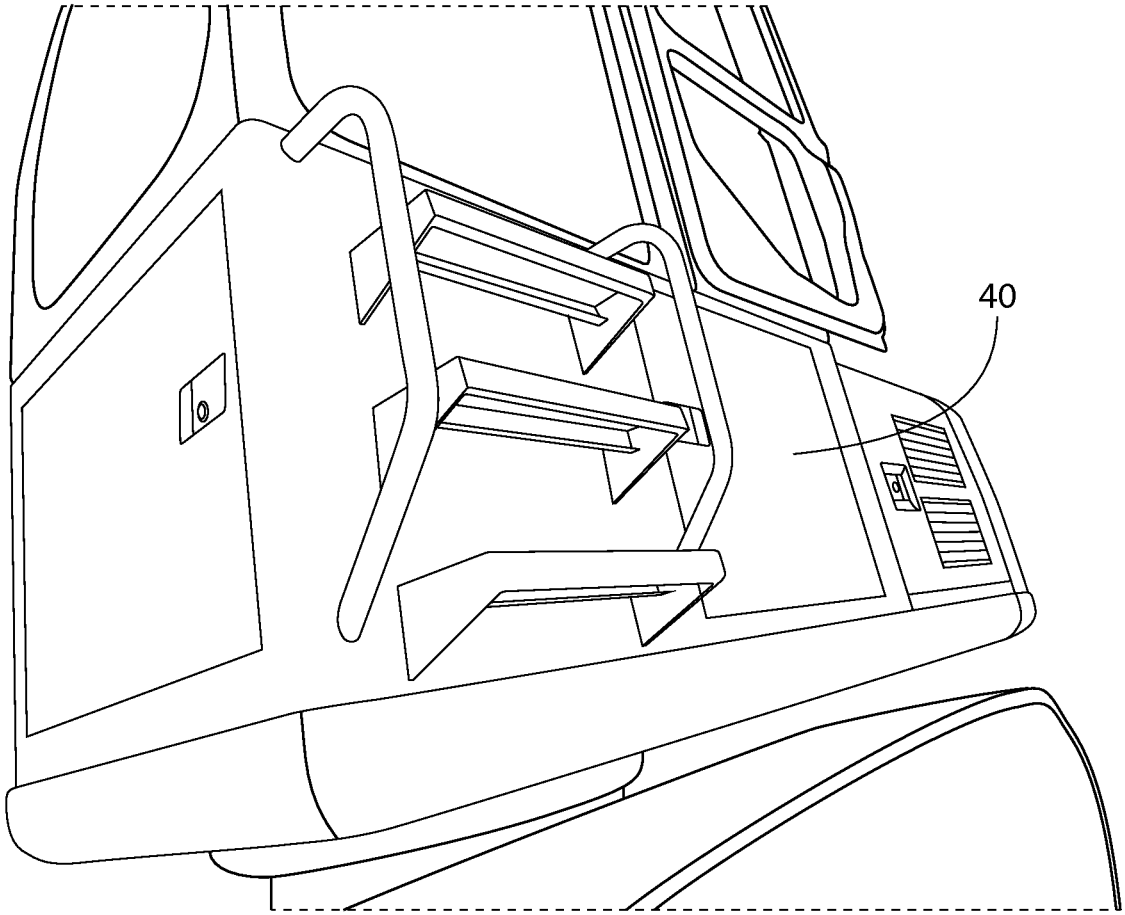
FIG. 10 is a left side perspective view of the auxiliary power unit excavator system according to aspects of the present disclosure.
Figure 11:
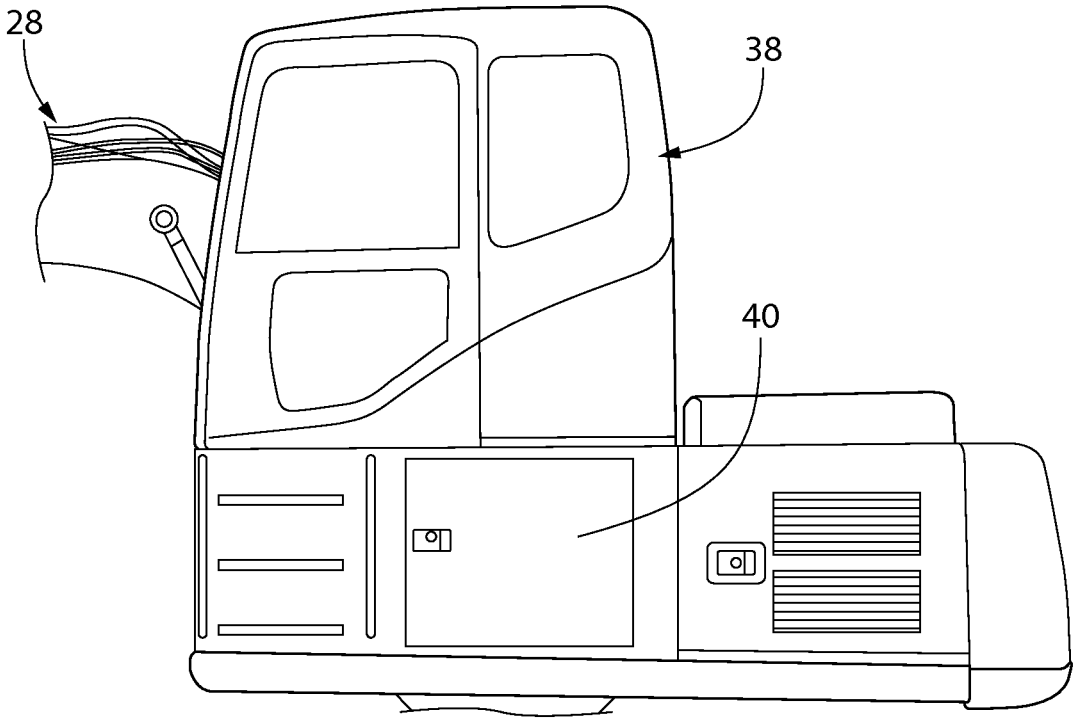
FIG. 11 is a left side elevation view of the auxiliary power unit excavator system according to aspects of the present disclosure.
Figure 12:
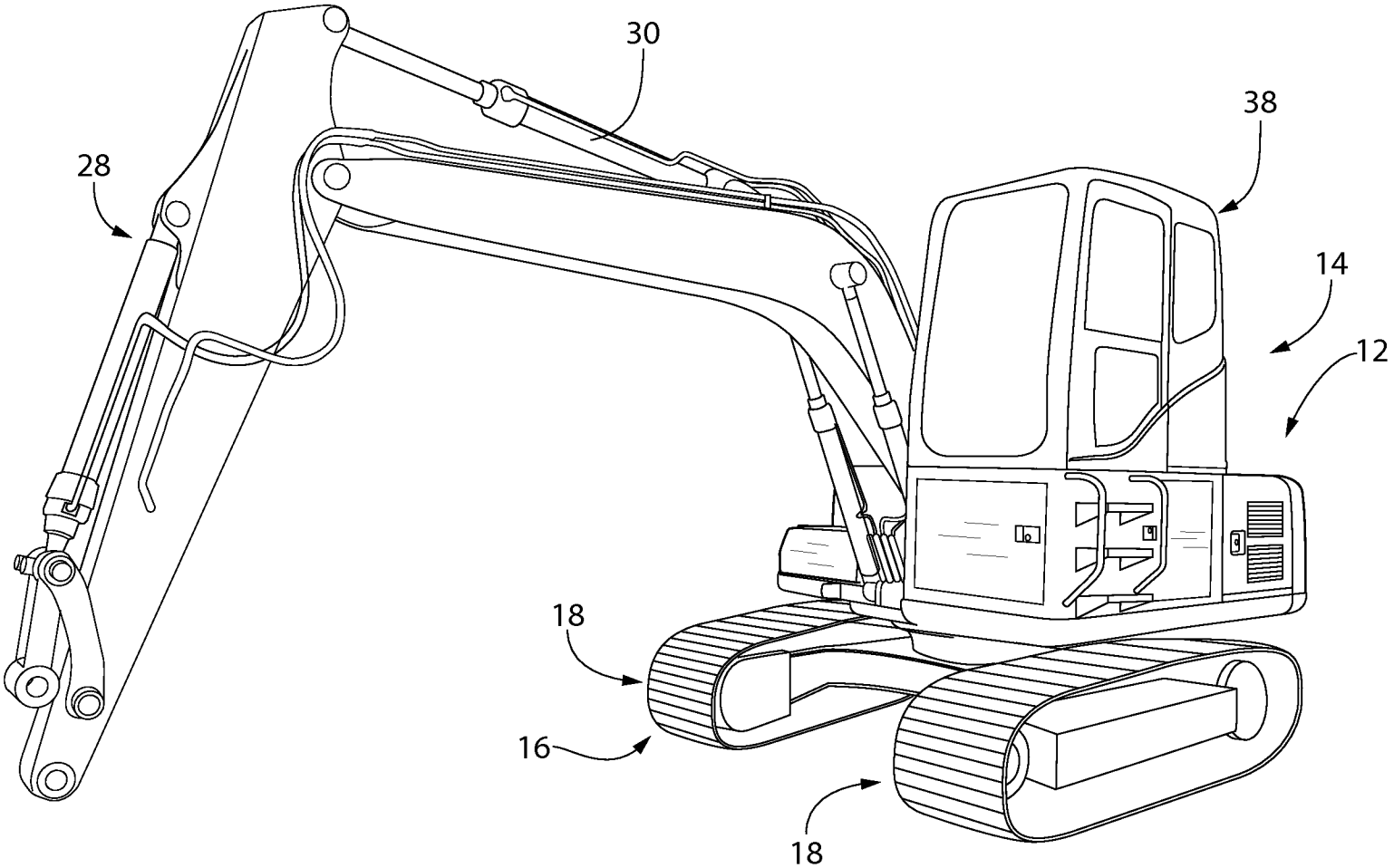
FIG. 12 is a front perspective view of the auxiliary power unit excavator system according to aspects of the present disclosure.
Figure 13:
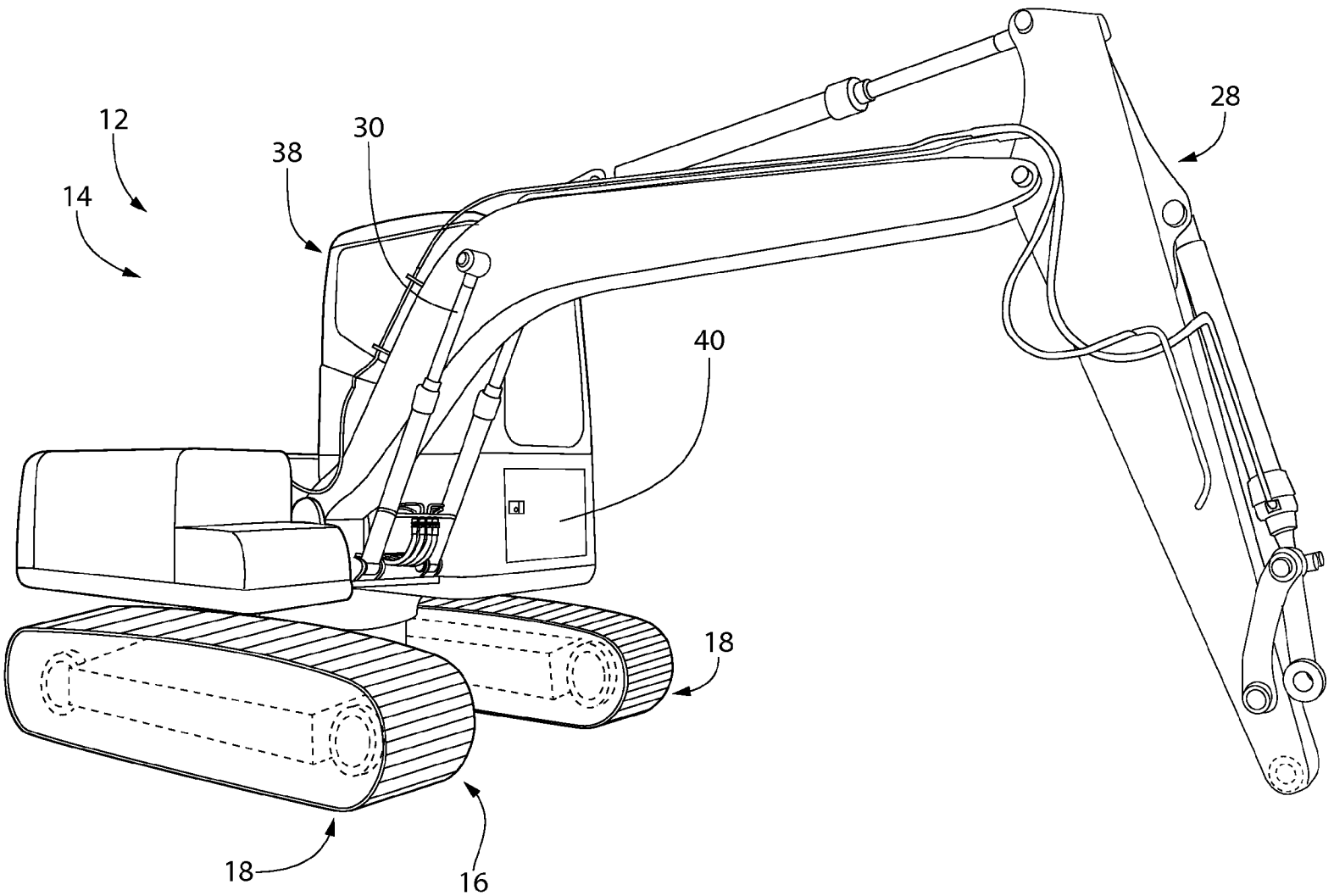
FIG. 13 is a front perspective view of the auxiliary power unit excavator system according to aspects of the present disclosure.
Figure 14:
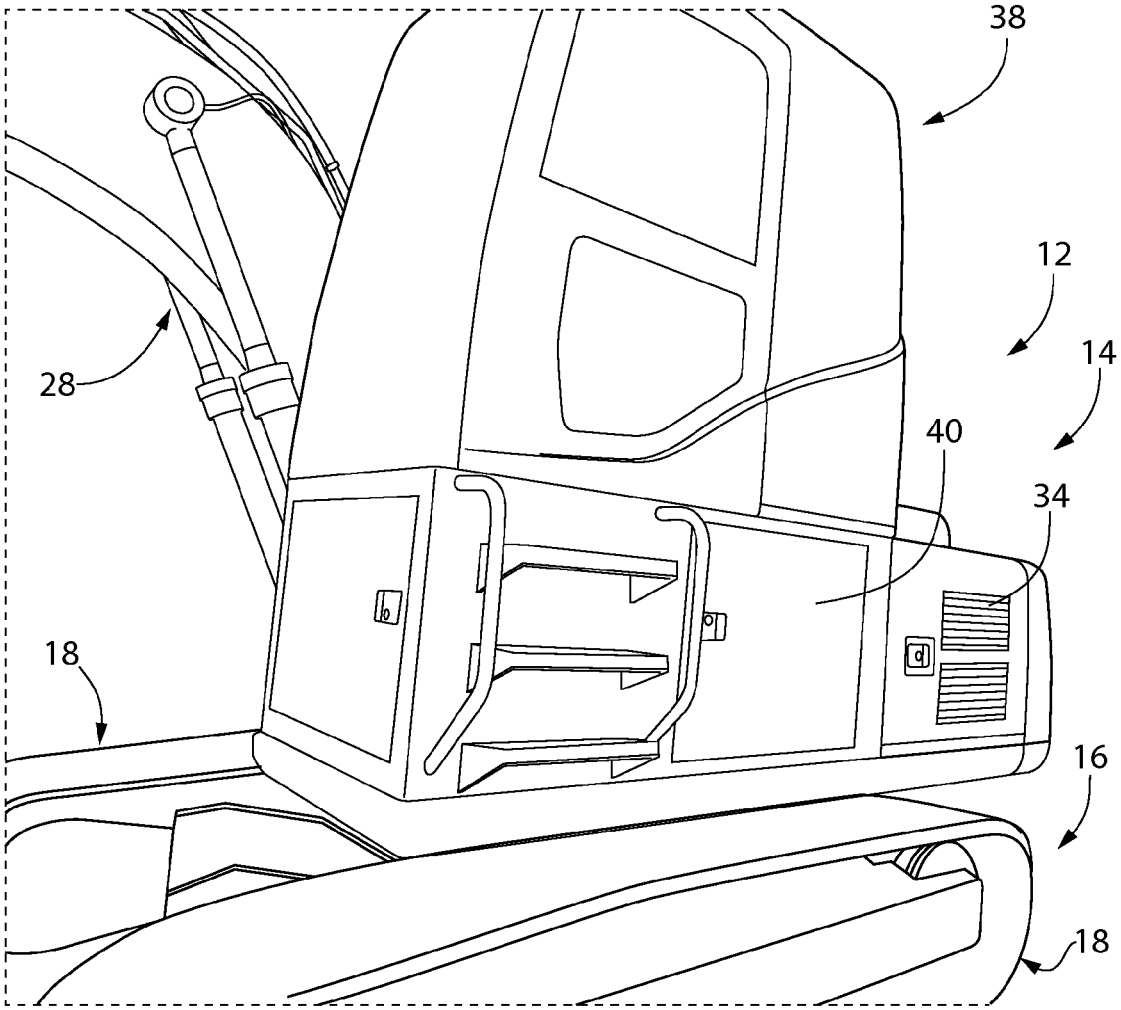
FIG. 14 is a left side perspective view of the auxiliary power unit excavator system according to aspects of the present disclosure.

Referring now to FIGS. 1-4, an auxiliary power unit excavator system 12 of an embodiment of the present disclosure is provided. An excavator 14 of an embodiment includes a vehicular base 16. The vehicular base 16 includes a transmission in the form of track assemblies 18 to enable mobility of the excavator 14, as shown in FIGS. 1-3. Referring now to FIG. 4, the auxiliary power unit excavator system 12 further features a circulating hydraulic fluid system 22 that includes a hydraulic fluid reservoir 24. The hydraulic fluid system 22 circulates hydraulic fluid between the reservoir 24, a hydraulic pump 26, and an excavator boom assembly 28. The excavator boom assembly 28 is disposed on a top side 42 of the vehicular base 16, as shown in FIG. 2. The excavator boom assembly 28 features at least one hydraulic actuator 30 coupled to the circulating hydraulic fluid system 22. The auxiliary power unit excavator system 12 further includes a fuel tank 32, a first internal combustion engine 34 comprising a fuel conduit system 36 connecting the fuel tank 32 to the first internal combustion engine 34.

FIGS. 5 and 10-14 further illustrate the excavator 14 and auxiliary power unit excavator system 12 of the present disclosure.

Referring now to FIGS. 2, 5, 6, 9, and 11-14, an operator cab 38 of an embodiment is disposed above an auxiliary power unit enclosure 40, which is disposed on the top side 42 of the vehicular base 16. Referring again to FIG. 4, the auxiliary power unit enclosure 40 of an embodiment contains an auxiliary power unit 44 comprising a second internal combustion engine 46. FIGS. 18A-18E include several views of the auxiliary power unit enclosure 40 of an embodiment of the present disclosure. The second internal combustion engine 46 of an embodiment shown in FIG. 4 is a single cylinder diesel engine. The second internal combustion engine 46 is fluidly coupled to a first coolant volume 48 and powers an alternating current generator 50 and a second coolant volume compressor 52 that circulates a second coolant volume 68. The A/C generator 50 of an embodiment shown in FIG. 4 generates 3500 watts. A second coolant volume condenser assembly 54 is fluidly coupled to the second coolant volume compressor 52 and comprises a second coolant volume condenser fan 56. A second internal combustion engine radiator 58 cools the first coolant volume 48. A first coolant reservoir 100 stores a portion of the first coolant volume 48 for circulation in an embodiment, as shown in FIG. 4. An electrical converter 60 of an embodiment is electrically coupled to the alternating current generator 50 and supplies direct current electricity to at least one battery 62 and a hydraulic fluid heating assembly 64. The hydraulic fluid heating assembly 64 of an embodiment further includes a heater controller 86 featuring a manual or electronic control device that an auxiliary power unit excavator system control unit, the operator, or another person or system can control directly or remotely. The auxiliary power unit excavator system 2 of the present disclosure may include multiple batteries 62 to supply or store electrical power separately, in series, or in parallel.

Figure 16:
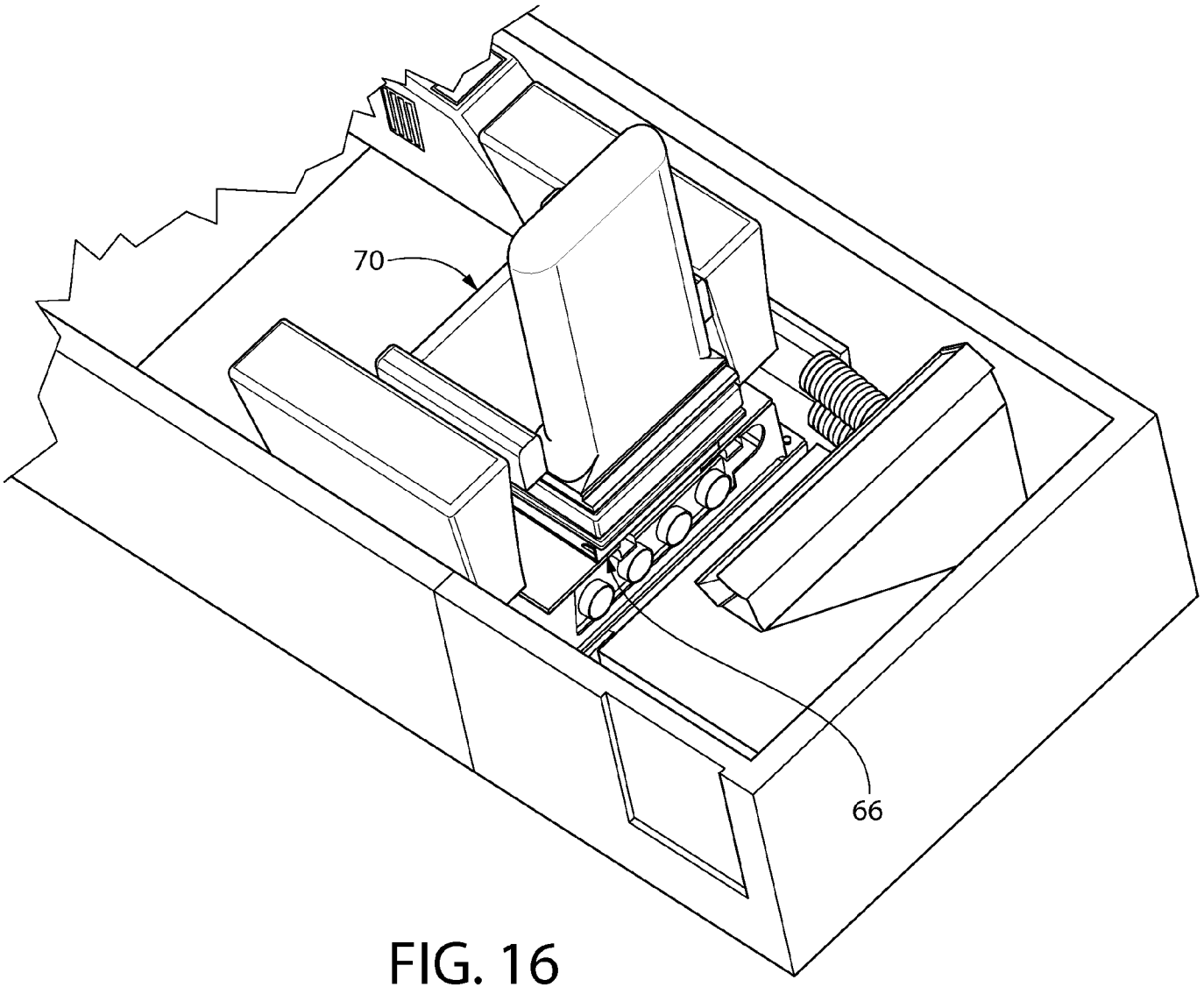
FIG. 16 is a top perspective view of an interior of the auxiliary power unit excavator system according to aspects of the present disclosure.
Figure 17:
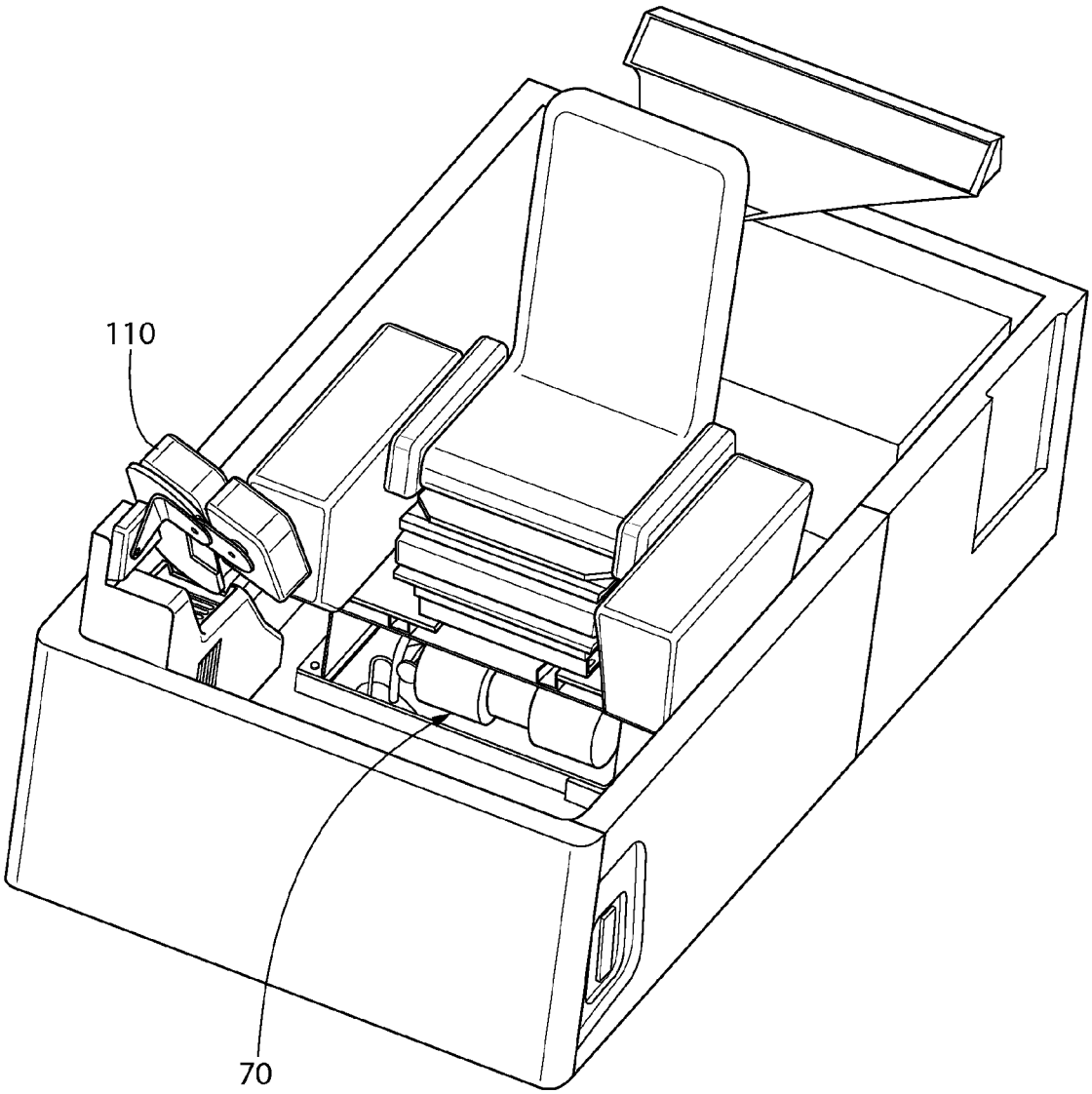
FIG. 17 is a top perspective view of an interior of the auxiliary power unit excavator system according to aspects of the present disclosure.
Figure 18A:
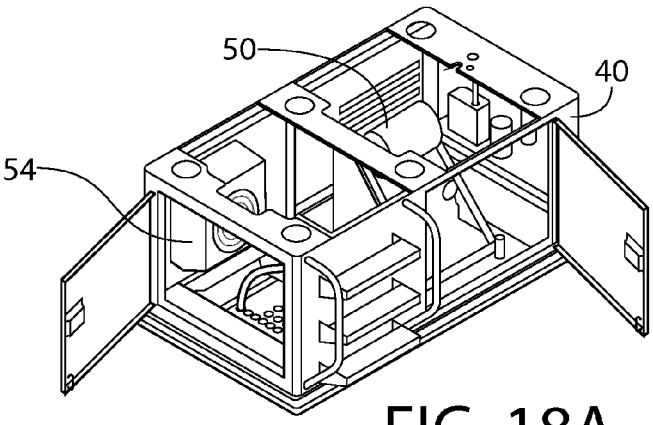
FIG. 18A is a left side perspective view of an auxiliary power unit enclosure of the auxiliary power unit excavator system according to aspects of the present disclosure.
Figure 18B:
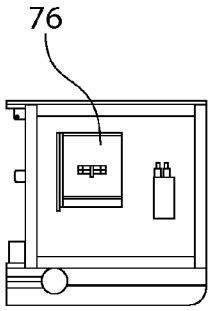
FIG. 18B is a cross sectional view of the auxiliary power unit enclosure of the auxiliary power unit excavator system according to aspects of the present disclosure.
Figure 18C:
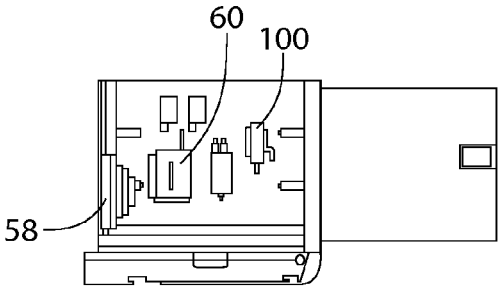
FIG. 18C is an enlarged cross sectional view of the auxiliary power unit enclosure of the auxiliary power unit excavator system according to aspects of the present disclosure.
Figure 18D:
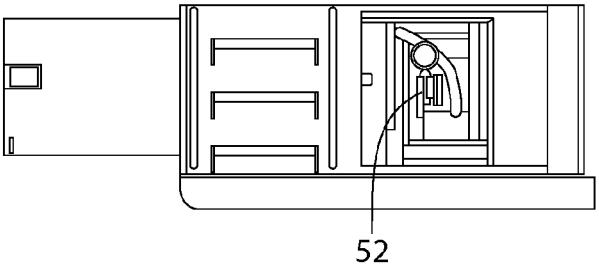
FIG. 18D is a left side elevation view of the auxiliary power unit enclosure of the auxiliary power unit excavator system according to aspects of the present disclosure.
Figure 18E:
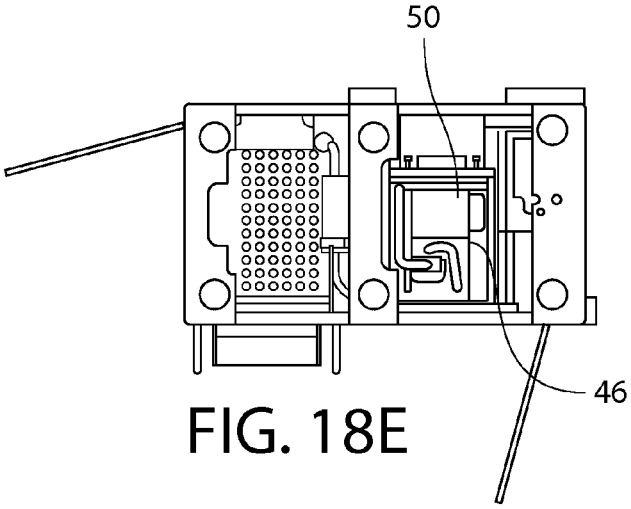
FIG. 18E is a top plan view of the auxiliary power unit enclosure of the auxiliary power unit excavator system according to aspects of the present disclosure.

As illustrated in FIGS. 16 and 17, an evaporator 66 of an embodiment is located inside the cab 38 and fluidly coupled to the second coolant volume 68 to provide air conditioning for the operator. A heater core 70 is also located inside the cab 38 and fluidly coupled to the first coolant volume 48 to provide heat for the operator. At least one blower fan is also located in the cab 38 to circulate the cool air near the evaporator 66 or the warm air near the heater core 70 around the inside of the cab 38.

The auxiliary power unit excavator system 12 of an embodiment further includes a first internal combustion engine starter 72 electrically coupled to the battery 62. When operation of the excavator 14 and its hydraulic functions is needed, the battery 62 supplies electrical power to the first internal combustion engine starter 72. The electrical converter 60 electrically coupled to the alternating current generator 50 of the present disclosure supplies direct current electricity to a cab operator outlet 74. The electrical converter 60 is electrically coupled to the alternating current generator 50 through an alternating current breaker panel 76. The second coolant volume condenser assembly 54 of an embodiment of the present disclosure shown in FIG. 4 is disposed on a first side 78 of the auxiliary power unit enclosure 40 that is adjacent to the excavator boom assembly 28. Air is directed into the auxiliary power unit enclosure 40 at the second coolant volume condenser assembly 54. The location of the second coolant volume condenser assembly 54 on the first side 78 of the auxiliary power unit enclosure 40 minimizes the amount of dirt, debris, or other foreign material that the fan of the condenser assembly 54 would draw into the auxiliary power unit enclosure 40.

Figure 15:
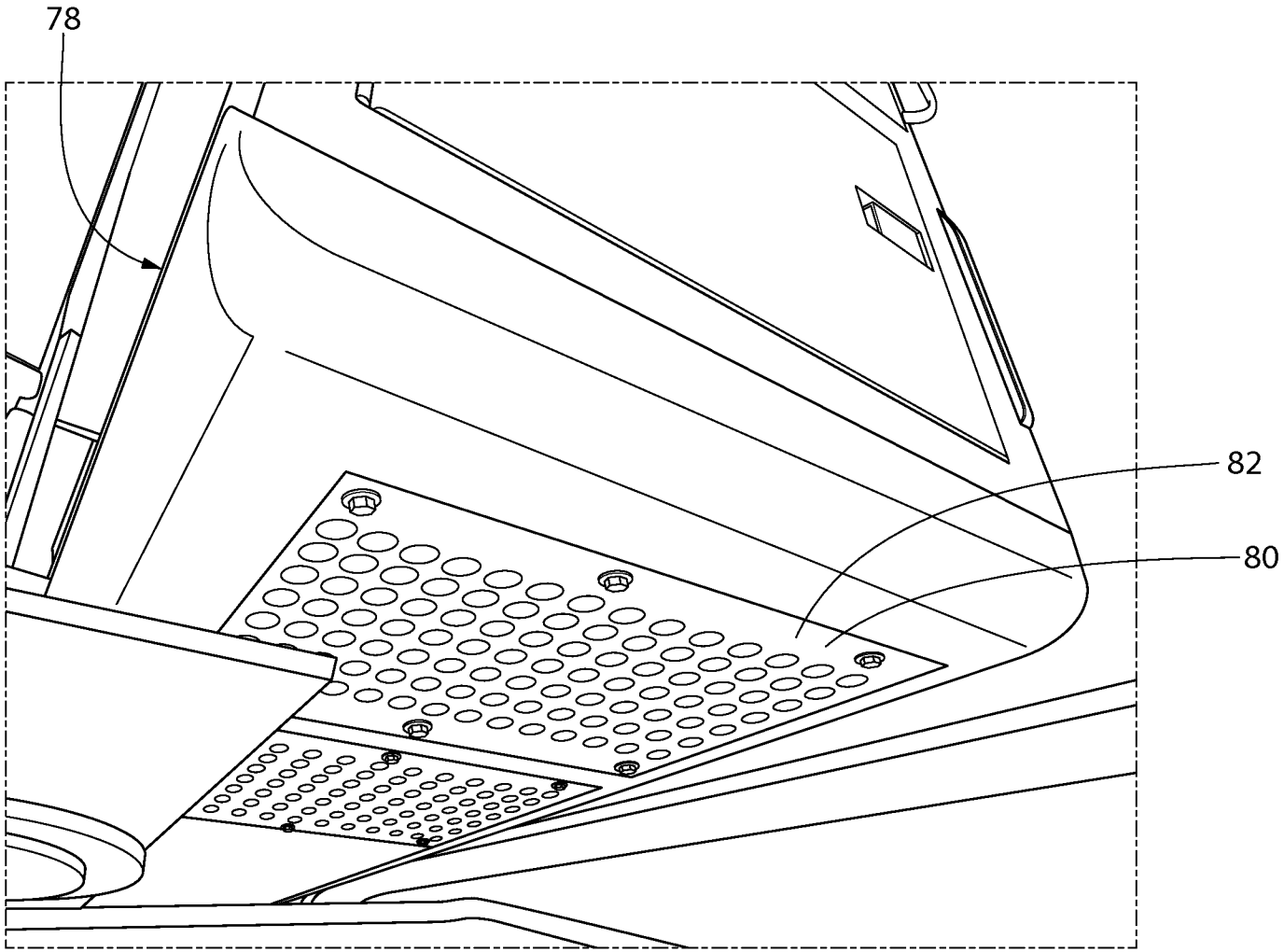
FIG. 15 is a bottom perspective view of the auxiliary power unit excavator system according to aspects of the present disclosure.

The auxiliary power unit enclosure 40 in an embodiment of the present disclosure includes an air outlet 80 at a second side 82, which is the lower side as shown in FIGS. 3, 4, and 15, of the auxiliary power unit enclosure 40. Air 102 directed into the auxiliary power unit enclosure 40 is directed out of the auxiliary power unit enclosure 40 through the air outlet 80. A second internal combustion engine exhaust assembly 82 handles the exhaust gases from the second internal combustion engine 46 and is disposed in an air pathway defined by the air 102 flowing between the second coolant volume condenser assembly 54 and the air outlet 80. As air is directed downward through the air outlet 80, heat from the high temperature exhaust assembly 82 is carried downward and out of the auxiliary power unit enclosure 40 through the air outlet 80. The removal of this waste heat enhances the air conditioning effect by preventing the waste heat from rising and heating the interior of the cab 38 directly above, as most clearly shown in FIG. 3.

The second internal combustion engine radiator 58 of an embodiment of the present disclosure is also disposed on the first side 78 of the auxiliary power unit enclosure 40 adjacent the excavator boom assembly 28. As shown in FIG. 4, the radiator 58 of an embodiment is located rearward of the second coolant volume condenser assembly 54. Also shown in FIG. 4, the electrical converter 60 of an embodiment is disposed on a third side 86 of the auxiliary power unit enclosure 40, which is located at a rear end of the auxiliary power unit enclosure 40.

The auxiliary power unit excavator system 12 circulates hot engine coolant from the first coolant volume 48 through the first internal combustion engine 34 while the first internal combustion engine 34 is shut down. This keeps the first internal combustion engine 34 up to operating temperature, thereby enabling it to be started on a moment's notice and immediately put to work. As detailed above, an embodiment of the auxiliary power unit excavator system 12 also provides electric heating to the excavator hydraulic oil through the hydraulic fluid heating assembly 46, which keeps the hydraulic fluid system 22 up to operating temperature so that it can be used without risk of damage immediately after starting the first internal combustion engine 34.

Further, the auxiliary power unit excavator system 12 provides monitoring and charging of the battery 62 through the electrical converter 60. This further allows immediate start-up of the first internal combustion engine 34 by preventing a dead battery that can prohibit operation of the starter 72. The auxiliary power unit excavator system 12 also features a low battery auto-start function that automatically starts the second internal combustion engine 46 when the power of the battery 62 drops below a particular threshold. This further enables any batteries 62 of the hydraulic excavator to remain charged during long storage periods.

As detailed above and further illustrated in FIGS. 6-9, the auxiliary power unit excavator system 12 enhances operator comfort by providing heat and air conditioning to the operator cab 38 for climate control. Additionally, an A/C power connection 90 and the D/C power connection 74 are provided inside of the cab 38 to power any convenience or entertainment items, or any tool to aid the operator on the job site. The auxiliary power unit excavator system 12 is conveniently controlled by the operator from the cab 38 through the system controller 110. The system controller 110 of an embodiment of the present disclosure controls each aspect and function of the auxiliary power unit excavator system 12 disclosed herein via a user interface.

An embodiment of the present disclosure, as displayed in FIGS. 1-3, features the elevated cab 38 to improve visibility for the operator for the mixing and removal process described above. Additionally, the components of the auxiliary power unit excavator system 12 are conveniently packaged directly below the elevated cab 38 to allow easy access for diagnosis, maintenance, or repair of any aspect of the auxiliary power unit excavator system 12.

The auxiliary power unit excavator system 12 with elevated cab 38 of the present disclosure provides particular advantages in the industry, especially for support functions of an oil or gas well drilling operation. Operating the second internal combustion 46 instead of the first internal combustion 34, which is the large hydraulic excavator diesel engine, during the 16 to 18 hours per 24 of no load idle time eliminates the failure problems with an exhaust after treatment system, such as a system used on a hydraulic excavator equipped with an EPA Tier IV diesel engine.

Additionally, operating the auxiliary power unit excavator system 12 during idle time prevents the accumulation of operating hours on the hydraulic excavator, thereby increasing the excavator service life. Further, operating the first internal combustion engine 34 at idle can consume over two gallons of diesel fuel per hour. In contrast, operating the second internal combustion 46 consumes approximately one-third of a gallon of diesel fuel per hour. This provides significant fuel cost savings and prevents excessive amounts of diesel exhaust from being released into the environment.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. An auxiliary power unit excavator system, comprising:

a. a vehicular base comprising a transmission;

b. a circulating hydraulic fluid system;

c. an excavator boom assembly disposed on a top side of said vehicular base and comprising at least one hydraulic actuator coupled to said circulating hydraulic fluid system;

d. a fuel tank;

e. a first internal combustion engine comprising a fuel conduit system;

f. the fuel conduit system connecting said fuel tank to said first internal combustion engine;

g. an auxiliary power unit enclosure disposed on a top side of said vehicular base, said enclosure containing:

i. an auxiliary power unit comprising a second internal combustion engine fluidly coupled to a first coolant volume and powering an alternating current generator and a second coolant volume compressor;

ii. a second coolant volume condenser assembly fluidly coupled to said second coolant volume compressor, said second coolant volume condenser assembly comprising a second coolant volume condenser fan;

iii. a second internal combustion engine radiator configured to cool said first coolant volume; and iv. an electrical converter electrically coupled to said alternating current generator and configured to supply direct current electricity to a battery and a hydraulic fluid heating assembly; and h. a cab disposed above said auxiliary power unit enclosure.

2. The auxiliary power unit excavator system of claim 1, wherein said cab further comprises an evaporator fluidly coupled to a second coolant volume.

3. The auxiliary power unit excavator system of claim 1, wherein said cab further comprises a heater core fluidly coupled to said first coolant volume.

4. The auxiliary power unit excavator system of claim 1, further comprising a first internal combustion engine starter electrically coupled to said battery such that said battery is configured to supply electrical power to said first internal combustion engine starter.

5. The auxiliary power unit excavator system of claim 1, wherein said electrical converter electrically coupled to said alternating current generator is configured to supply direct current electricity to a cab operator outlet.

6. The auxiliary power unit excavator system of claim 1, wherein said electrical converter is electrically coupled to said alternating current generator through an alternating current breaker panel.

7. The auxiliary power unit excavator system of claim 1, wherein said second coolant volume condenser assembly is disposed on an auxiliary power unit enclosure first side adjacent said excavator boom assembly, wherein air is directed into said auxiliary power unit enclosure at said second coolant volume condenser assembly.

8. The auxiliary power unit excavator system of claim 7, wherein said auxiliary power unit enclosure further comprises an air outlet disposed at an auxiliary power unit enclosure second side located at a lower end of said auxiliary power unit enclosure, said air directed into said auxiliary power unit enclosure is directed out of said auxiliary power unit enclosure through said air outlet.

9. The auxiliary power unit excavator system of claim 8, wherein said auxiliary power unit enclosure further comprises a second internal combustion engine exhaust assembly disposed in an air pathway defined by said air flowing between said second coolant volume condenser assembly and said air outlet.

10. An auxiliary power unit excavator system, comprising:

a vehicular base powered by a first internal combustion engine enabling excavator mobility;

an excavator boom assembly disposed on a top side of said vehicular base;

an auxiliary power unit enclosure disposed on a top side of said vehicular base; and a cab disposed above said auxiliary power unit enclosure, wherein said auxiliary power unit enclosure at least partially encloses:

a second internal combustion engine fluidly coupled to a first coolant volume and powering an alternating current generator and a second coolant volume compressor;

a second coolant volume condenser assembly fluidly coupled to said second coolant volume compressor, said second coolant volume condenser assembly comprising a second coolant volume condenser fan;

a second internal combustion engine radiator configured to cool said first coolant volume; and an electrical converter electrically coupled to said alternating current generator and configured to supply direct current electricity to a battery and a hydraulic fluid heating assembly.

11. The auxiliary power unit excavator system of claim 10, wherein said cab further comprises an evaporator fluidly coupled to said second coolant volume.

12. The auxiliary power unit excavator system of claim 10, wherein said cab further comprises a heater core fluidly coupled to said first coolant volume.

13. The auxiliary power unit excavator system of claim 12, further comprising a first internal combustion engine starter electrically coupled to said battery such that said battery is configured to supply electrical power to said first internal combustion engine starter.

14. The auxiliary power unit excavator system of claim 12, wherein said electrical converter electrically coupled to said alternating current generator is configured to supply direct current electricity to a cab operator outlet.

15. The auxiliary power unit excavator system of claim 12, wherein said electrical converter is electrically coupled to said alternating current generator through an alternating current breaker panel.

16. The auxiliary power unit excavator system of claim 12, wherein said second coolant volume condenser assembly is disposed on an auxiliary power unit enclosure first side adjacent said excavator boom assembly, wherein air is directed into said auxiliary power unit enclosure at said second coolant volume condenser assembly.

17. An auxiliary power unit excavator system, comprising:

A vehicular base powered by a first internal combustion engine enabling excavator mobility;

an excavator boom assembly disposed on a top side of said vehicular base;

an auxiliary power unit enclosure disposed on a top side of said vehicular base; and a cab disposed above said vehicular base, wherein said auxiliary power unit enclosure at least partially encloses:

a second internal combustion engine powering a generator and a compressor fluidly coupled to an air conditioning coolant;

a condenser assembly fluidly coupled to said compressor, said condenser assembly comprising a condenser fan configured to direct air into said auxiliary power unit enclosure;

an air outlet disposed at an auxiliary power unit enclosure side, wherein said air directed into said auxiliary power unit enclosure is directed out of said auxiliary power unit enclosure through said air outlet; and a second internal combustion engine exhaust assembly disposed in an air pathway defined by said air flowing between said condenser assembly and said air outlet.

18. The auxiliary power unit excavator system of claim 17, wherein said cab further comprises an evaporator fluidly coupled to an engine coolant fluidly coupled to said second internal combustion engine.

19. The auxiliary power unit excavator system of claim 17, wherein said cab further comprises a heater core fluidly coupled to said engine coolant.

20. The auxiliary power unit excavator system of claim 17, further comprising an electrical converter electrically coupled to said generator and configured to supply direct current electricity to a battery.

* * * * *